US005993237A

United States Patent [19]

Kern, Jr. et al.

[11] Patent Number: 5,993,237

[45] Date of Patent: Nov. 30, 1999

[54] MODULAR TELEPHONE PLUG

[75] Inventors: Joseph F. Kern, Jr., Islip, N.Y.; Gorm Bressner, Providence, R.I.; Jung-Ming Wu, Acton, Mass.

[73] Assignee: Aines Manufacturing Corp., Ronkonkoma, N.Y.

[21] Appl. No.: 09/289,675

[22] Filed: Apr. 12, 1999

Related U.S. Application Data

[63] Continuation of application No. 08/875,400, filed as application No. PCT/US96/00828, Feb. 1, 1996, Pat. No. 5,893,771, which is a continuation-in-part of application No. 08/382,634, Feb. 2, 1995, Pat. No. 5,562,475.

[51] Int. Cl.[6] ..... H01R 4/50

[52] U.S. Cl. ..... 439/344; 439/676

[58] Field of Search ..... 439/344–345, 439/350, 353, 354, 357, 676

[56] References Cited

U.S. PATENT DOCUMENTS

| | | |
|---|---|---|
| 3,192,499 | 6/1965 | West . |
| 3,369,214 | 2/1968 | Krumreich et al. . |
| 3,617,982 | 11/1971 | Hardesty . |
| 3,639,950 | 2/1972 | Lutz et al. . |
| 3,699,498 | 10/1972 | Hardesty et al. . |
| 3,721,939 | 3/1973 | Paugh . |
| 3,789,344 | 1/1974 | Brorein et al. . |
| 3,874,763 | 4/1975 | Hoover . |
| 4,002,392 | 1/1977 | Hardesty . |
| 4,094,571 | 6/1978 | Benjamin . |
| 4,148,539 | 4/1979 | Hardesty . |
| 4,174,879 | 11/1979 | Suverison . |
| 4,245,879 | 1/1981 | Buck . |
| 4,373,766 | 2/1983 | Johnston . |
| 4,548,455 | 10/1985 | Ezure . |
| 4,607,905 | 8/1986 | Vaden . |
| 4,623,210 | 11/1986 | Tsukakoshi . |
| 4,626,057 | 12/1986 | Knickerbocker . |
| 4,647,726 | 3/1987 | Blum . |
| 4,682,837 | 7/1987 | Thomas et al. . |
| 4,871,325 | 10/1989 | Maejima et al. . |
| 4,950,176 | 8/1990 | Cocco et al. . |
| 4,979,910 | 12/1990 | Revil et al. . |
| 5,169,329 | 12/1992 | Taguchi . |
| 5,178,552 | 1/1993 | Jinno et al. . |
| 5,186,649 | 2/1993 | Fortner et al. . |
| 5,192,225 | 3/1993 | Suzuki . |
| 5,219,300 | 6/1993 | Yagi et al. . |
| 5,246,380 | 9/1993 | Kodama . |
| 5,254,014 | 10/1993 | Yagi et al. . |
| 5,292,258 | 3/1994 | Sakurai . |
| 5,292,855 | 3/1994 | Krutak et al. . |
| 5,308,260 | 5/1994 | Johnston et al. . |
| 5,308,261 | 5/1994 | Kightlinger . |
| 5,328,390 | 7/1994 | Johnston et al. . |
| 5,330,366 | 7/1994 | Tsuji et al. . |
| 5,348,493 | 9/1994 | Power . |
| 5,354,212 | 10/1994 | Bartle et al. . |
| 5,356,304 | 10/1994 | Colleran . |
| 5,382,176 | 1/1995 | Norden . |
| 5,382,182 | 1/1995 | Shen et al. . |
| 5,385,484 | 1/1995 | Bartle et al. . |
| 5,387,135 | 2/1995 | Shen et al. . |
| 5,391,090 | 2/1995 | Power . |
| 5,395,268 | 3/1995 | Okada . |
| 5,399,107 | 3/1995 | Gentry et al. . |
| 5,562,465 | 10/1996 | Kern, Jr. et al. . |
| 5,893,771 | 4/1999 | Kern, Jr. et al. . |

*Primary Examiner*—Kheim Nguyen
*Attorney, Agent, or Firm*—Everett G. Diederiks, Jr.

[57] ABSTRACT

A modular telephone plug having an elongated dielectric housing and a clip member attached that is adapted to fit into a standard RJ-type jack. More specifically, one end of the modular plug defines an electrical connector section to which wires from a telephone cord can be attached. For this purpose, the housing includes an internal channel through which the telephone cord can extend. The clip member is secured in a cantilevered manner at an end of the housing remote from the electrical connector section. The housing is also formed with a recess into which extends a free end of the clip member. The modular plug has an associated length of 1.1 to 1.5 inches (approximately 2.8 to 3.8 cm). With this construction, the modular telephone plug can be easily grasped and manipulated.

9 Claims, 5 Drawing Sheets

MODULAR TELEPHONE PLUG

This is a continuation of U.S. patent application Ser. No. 08/875,400, filed Jul. 31, 1997, now U.S. Pat. No. 5,893,771, which represents a U.S. national stage filing of PCT/US96/00828, filed Feb. 1, 1996, which is a continuation-in-part of U.S. patent application Ser. No. 08/382,634, filed Feb. 2, 1995 now U.S. Pat. No. 5,562,475.

BACKGROUND OF THE INVENTION

1. Field of the Invention

This invention relates to a modular telephone plug for connection to a standard RJ-type jack.

2. Description of the Prior Art

Typically telephone cords are used to connect a telephone to either a wall terminal or to connect the telephone to its handset. These telephone cords may run inside or outdoors to establish necessary telephone communication. The actual telephone cords generally comprise a core having a plurality of tinsel or ribbons wrapped helically thereabout. The tinsel conductors are covered with an insulative covering and then a plurality of the individual insulated conductors are typically jacketed with a plasticized polyvinyl chloride composition.

Usually, each end of the cord arrangement is terminated with a miniature modular plug to facilitate attachment to the jacks located in various telephone instruments and wall outlets. One end of the modular plug is adapted to receive a cord while the other end of the modular plug is adapted to be inserted into a jack to establish electrical connection between the core conductors within the plug and the contact elements in the form of wires in the jack. A typical modular plug can be seen in U.S. Pat. Nos. 3,699,498 and 4,148,539.

As can be seen in FIGS. 1–3 of the attached drawings, a standard modular plug 10 includes a plastic housing 12. A first end 14 of the housing 12 has conductor receiving troughs 16 which communicate with a cord receiving opening 18 at the second end 20 of the plug 10. The first end 14 of the plug 10 includes receiving walls 22 which extend between and aid in defining the troughs 16.

As can be best seen in FIG. 3, the housing 12 incorporates a depressible tab 24 for locking the plug 10 within a jack 26. The tab 24 is formed with two, laterally spaced, detent members 28. These detent members 28 are adapted to engage the modular jack 26 thus locking the plug 10 in place. This prior art plug 10 and jack 26 connecting arrangement is satisfactory for intermittent household use. However, there presently exists a need to have testing plugs which will be used by a workman to test several jacks in a single given day. Repeatedly using a prior art plug constructed in the manner described above will inevitably lead to fatigue failure problems. For example, the tab 24 will tend to break off at its neck portion 30 if the plug 10 is used often.

Furthermore, as seen in FIG. 3, only a portion 32 of the plug 10 extends outward of the jack 26 when the plug is engaged. This presents grasping problems to workmen who often need to wear gloves which makes it difficult to grasp and pull a plug out of a jack if there is only a small portion of the plug extending beyond the jack. It is also often difficult to readily deflect the tab 24 which has only a small portion 34 extending beyond the jack 26.

Thus, the prior art technology has failed to provide a modular plug which can fit into a standard jack and yet is large enough to be easily held and removed by a worker who has gloved hands and which incorporates a reliable locking tab or clip that will not break even after repeated use.

SUMMARY OF THE INVENTION

This invention provides for a durable modular telephone plug particularly adapted for use by workers who are testing telephone equipment or making necessary repairs to telephone equipment. The modular telephone plug is enlarged relative to a standard RJ-type modular plug to aid in grasping the same and incorporates a mechanically reliable locking arrangement.

More specifically, the invention is directed to a modular telephone plug having an elongated, preferably unitarily molded, dielectric housing with first and second longitudinally spaced ends. The first end is adapted to fit into a standard modular telephone jack, such as normally would be found in standard telephone equipment. The second end of the housing is spaced from the first end to enlarge a gripping zone associated with the modular plug. In addition, the second end is formed with an enlarged head portion that protrudes from the housing such that the combination of the housing's size and shape enables the plug to be easily manipulated by a user even if the user is wearing gloves. The housing also has a channel passing from the second end of the housing to the first. This channel is adapted to receive a standard telephone wire assembly that leads to the first end of the housing. The first end is actually constructed substantially the same as a standard telephone plug in order to enable the modular telephone plug of the present invention in readily fit into standard telephone jacks.

An elongated retainer clip is provided that extends from the first end of the housing to the second end thereof. Adjacent the first end of the housing, the retainer clip has at least one detent member which is adapted to be engaged with a standard modular RJ-type jack in order to securely hold the modular plug in place. A recess is located in the housing at its first end and a tab formed at the terminal end of the clip is adapted to extend into the recess. According to a first embodiment, the second end of the housing is formed with a plurality of bores into which three corresponding pegs carried by an opposing end of the clip are received for securing the clip to the housing. The resulting connection allows for relative movement between the housing and the clip to enable disengagement of the detent members from the jack. According to another embodiment, the housing is essentially the same as in the first embodiment, however, a slot is formed in the second end of the housing. The slot extends, within the housing, from the second end of the housing, toward the first end thereof substantially parallel to the cord receiving channel. The slot is adapted to frictionally receive a portion of the clip of the second embodiment to secure the clip to the housing. More specifically, the portion of the clip of the second embodiment which is inserted into the slot has barbed or spiked members extending laterally therefrom for frictionally securing the clip to the housing. Various ribs can be provided along a bottom side of the clip to enhance the structural integrity of the clip.

The construction of either embodiment provides for an oversized modular telephone plug which can be formed in a cost effective manner and used in any standard jack. The resulting plug is sturdy and strong and its associated clip can be readily manipulated without failing under fatigue loading even when used repeatedly by workmen in testing telephone equipment. Furthermore, the shape and size of the housing further enables the modular telephone plug to be easily grasped by telephone personnel.

Additional objects, features and advantages of the present invention will be more readily apparent from the following description of the preferred embodiments thereof, when taken in conjunction with the drawings appended hereto in which like reference numerals refer to corresponding parts in the several views.

DETAILED DESCRIPTION OF THE PREFERRED EMBODIMENTS

Figure 4:
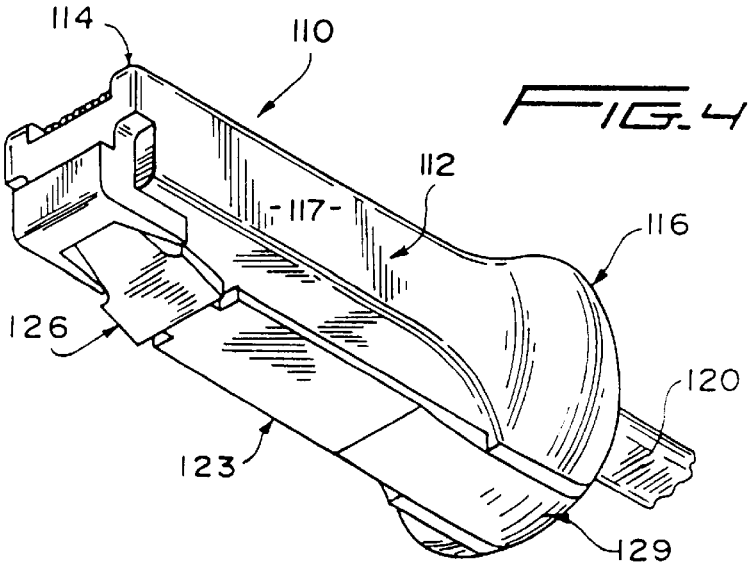
FIG. 4 is a perspective view of a first preferred embodiment of the modular telephone plug of the present invention.
Figure 5:
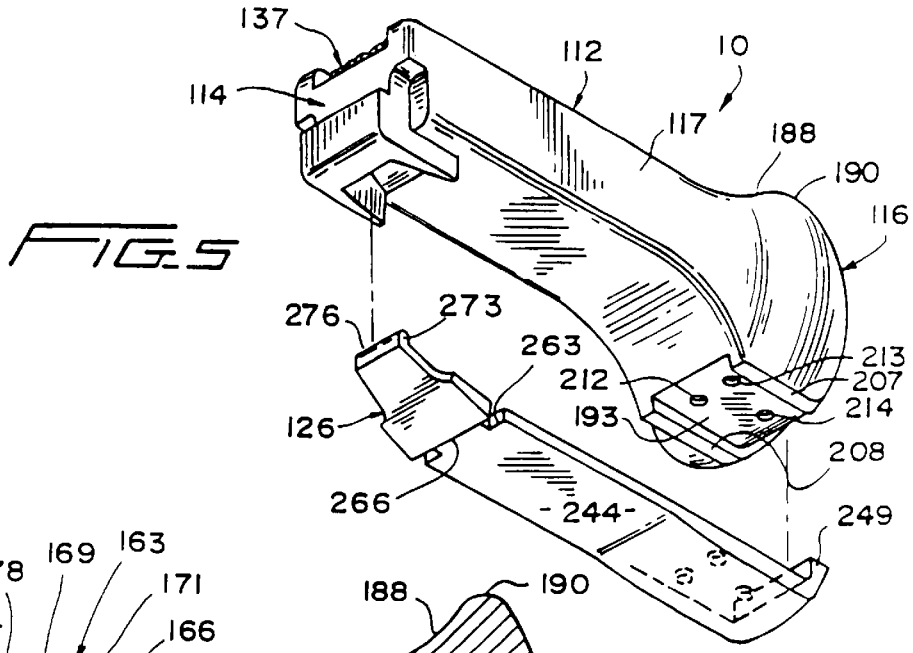
FIG. 5 is an exploded, perspective view of the modular telephone plug of FIG. 4.
Figure 6:
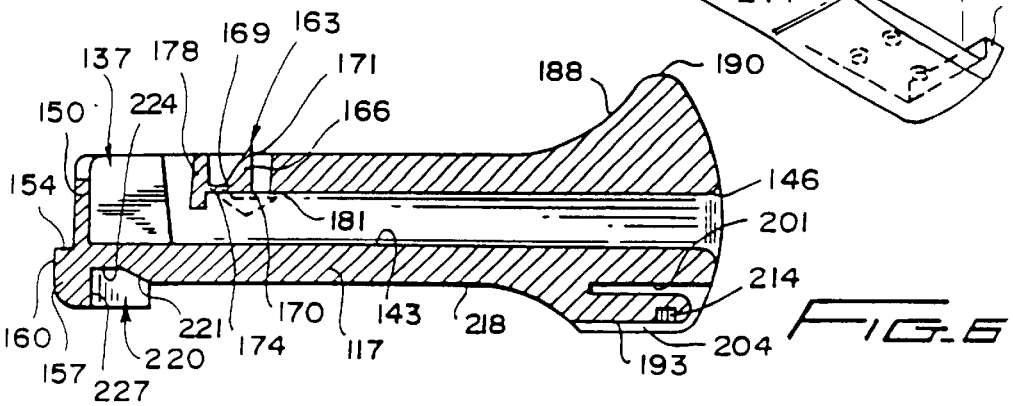
FIG. 6 is a longitudinal cross-sectional view of a preferred embodiment of the housing portion of the modular telephone plug of the present invention.
Figure 7:
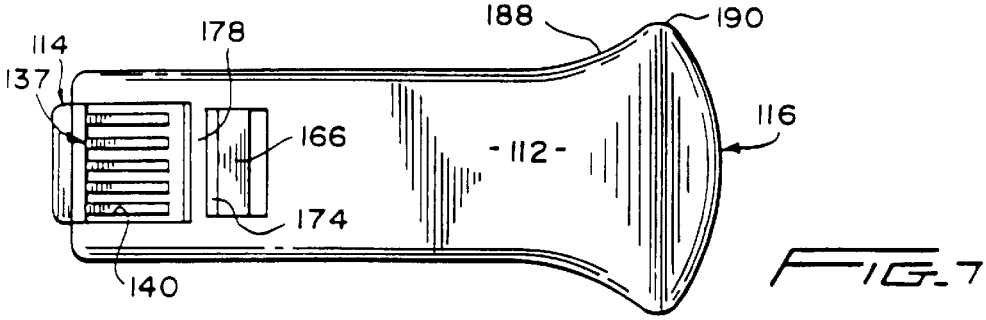
FIG. 7 is a top plan view of the housing of FIG. 6.

With initial reference to FIGS. 4 and 5, a modular telephone plug according to the present invention is generally indicated at 110. Modular plug 110 includes a housing 112 having a first end 114 and a second end 116 that are interconnected by a central body portion 117. In the preferred embodiment, housing 112 constitutes a unitary member that is injection molded of plastic, however, it should be understood that other manufacturing methods could be employed to form housing 112 and that other dielectric materials could also be utilized.

Housing 112 is adapted to receive a telephone cord 120 which extends through housing 112 from second end 116 to first end 114 in the manner which will be more fully described below. Modular plug 110 is also provided with a clip member 123 that includes a first end portion 126 adapted to be selectively secured within a standard telephone jack and a second end portion 129 which is adapted to be fixedly secured to second end 116 of housing 112. Three preferred embodiments for the clip member incorporated in the modular plug 110 of the present invention will be described more fully below, along with the respective attachment arrangements between the clip member and the housing 112. In addition, the construction of the clip member which provides for selectively locking first end 114 of housing 112 within a standard telephone jack will also be described in detail below.

Reference will now be made to FIGS. 6–10 in describing the preferred embodiment of housing 112. In general, first end 114 of housing 112 is configured in a manner substantially identical to that of a standard modular plug, i.e., plug 10 shown in FIGS. 1–3 of the present application, such that first end 114 can be readily received within a standard telephone jack. In accordance with the particular construction of housing 112, first end 114 defines an electrical connector section 137 that is formed with a plurality of laterally spaced conductor receiving troughs 140. Within housing 112, conductor receiving troughs 140 open into a longitudinally extending channel 143. Channel 143 extends within housing 112 from first end 114 to an opening 146 formed in second end 116.

In a manner similar to a standard modular plug, first end 114 of housing 112 is provided with a substantially flat front wall 150 that leads to a ledge 154. Ledge 154 projects forwardly from front wall 150 to define a forward extension 157 that has a front surface 160. The width of first end 114 is identical to that of a standard modular plug (i.e., approximately ⅜ inch or 1 cm). With this construction, first end 114 can readily be inserted within a standard RJ-type jack, such as that illustrated in FIG. 3.

Housing 112 further incorporates a wire retaining member 163 that is preferably formed as a generally triangularly-shaped body 166 having corners 169–171. Corner 169 is integrally formed with a flexible appendage 174 that is attached to portion 178 of housing 112. When the wires of telephone cord 120 are inserted into opening 146, through channel 143 and into conductor receiving troughs 140, wire retaining member 163 can be manually pivoted relative to housing 112 due to the flexibility of appendage 174. In order to retain telephone cord 120 within channel 143, wire retaining member 163 is adapted to pivot between the non-restraining position shown in FIG. 6 to the restraining position illustrated by dotted lines wherein corner 170 will engage telephone cord 120 in order to retain it in a desired position. When in its cord restraining position, a portion of triangular-shaped body 166, adjacent corner 171, rests upon lip 181 to prevent wire retaining member 163 from readily shifting back to its non-restraining position. Since the particular manner in which the wires of telephone cord 120 are secured within conductor receiving troughs 140 so as to define electrical connector section 137 is identical to that of the prior art and is well known in the art, this arrangement has not been depicted in the drawings and will not be described in detail herein.

Figure 9:
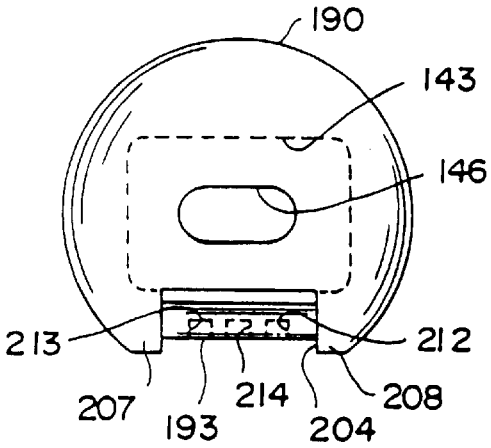
FIG. 9 is a rear end view of the housing shown in FIG. 6.
Figure 10:
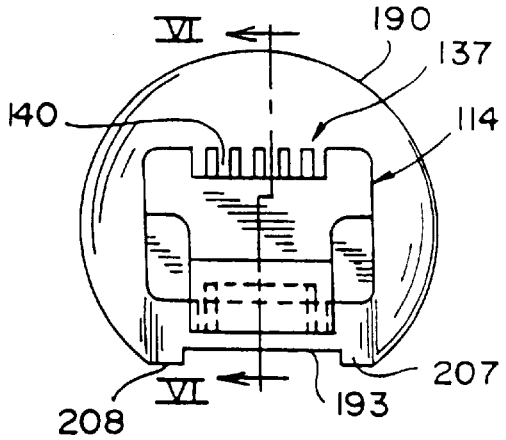
FIG. 10 is a front end view of the housing shown in FIG. 6.

As clearly illustrated in these Figures, second end 116 of housing 112 includes a concavely sloped surface 188 that extends outwardly from central body portion 117 such that second end 116 defines an enlarged head. Enlarging second end 116 in accordance with the present invention has been found to greatly enhance one's ability to grasp modular plug 110 of the present invention. From concavely sloped surface 188, second end 116 is formed with a rounded portion 190 that extends about more than three sides of housing 112 as best illustrated in FIGS. 9 and 10. The ends of rounded portion 190 are interconnected by a flattened section 193. Below flattened section 193, housing 112 is formed with a slot 201 that extends longitudinally within second end 116 substantially parallel to channel 134. Slot 201 leads to a grooved channel 204 defined between upstanding side walls 207 and 208 at flattened section 193.

Figure 8:
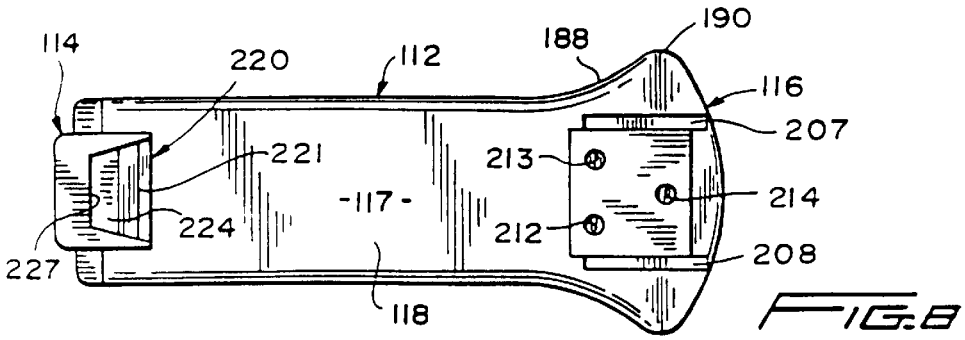
FIG. 8 is a bottom plan view of the housing of FIG. 6.

As illustrated in the preferred embodiment shown, grooved channel 204 is provided with a plurality of spaced bores 212–214. Grooved channel 204 opens toward a side 218 of central body portion 117. Side 218 is preferably formed substantially flat and leads to a recess 220 formed in first end 114 of housing 112. Recess 220 is defined by a sloped surface 221 that extends from side 218, a flattened section 224 and an upstanding wall 227. As best illustrated in FIG. 8, recess 220 is only provided in a central region of housing 112 along side 218.

Figure 11:
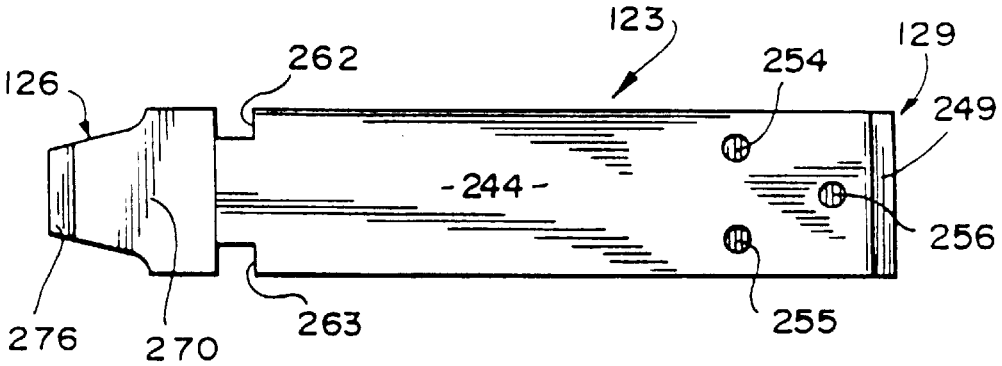
FIG. 11 is a bottom plan view of a retainer clip constructed in accordance with a first embodiment of the invention.
Figure 12:
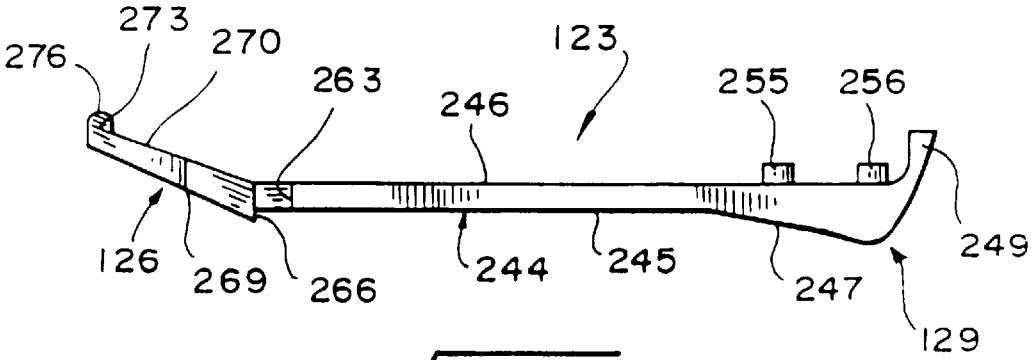
FIG. 12 is a side view of the retainer clip of FIG. 11.

As will be evident from the remainder of this detailed description, housing 112 in accordance with the preferred embodiment of the invention is constructed for use with varying types of clip members. Once such clip member is illustrated in FIGS. 4, 5, 11 and 12 and is generally indicated at 123 as mentioned above. Clip member 123, which is preferably constituted by an integrally formed elongated plastic body, includes an elongated central portion 244 that interconnects first and second ends 126 and 129. With particular reference to FIGS. 11 and 12, clip member 123 includes a first side surface 245 and an opposing side surface 246. First side surface 245 is preferably formed substantially flat along elongated central portion 244 and includes an inclined section 247 at second end portion 129 such that second end portion 129 defines a thickened section of clip member 123. This inclined section 247 leads to an in-turned flange 249. Substantially opposed to inclined section 247 on side surface 246, second end portion 129 is formed with a plurality of spaced pegs 254–256. As will be described more fully below, pegs 254–256 are utilized to securely attach second end portion 129 of clip member 123 to housing 112 of modular plug 110.

Directly adjacent first end 126 of clip member 123, elongated central portion 244 is formed with opposing cut-out portions 262 and 263. As best illustrated in FIG. 12, first end portion 126 extends upwardly from elongated central portion 244 on first side surface 245 such that first end 126 defines a raised lip 266 that extends across clip member 123. First end portion 126 is defined by opposing surfaces 269 and 270 that slope relative to elongated central portion 244 and which terminate in a tab 273 having a rounded terminal end 276.

Clip member 123 described above is adapted to be attached to housing 112 by securing second end portion 129 to housing 112 within grooved channel 204. More specifically, pegs 254–256 formed on second end portion 129 are fixedly secured within a respective one of the plurality of bores to 212–214. According to a preferred embodiment, second end portion 129 is adhesively secured within grooved channel 204 along with pegs 254–256 within bores 212–214. Elongated central portion 244 and first end 126 extend from second end portion 129 in a cantilevered manner and tab 273 projects within recess 220.

Figure 1:
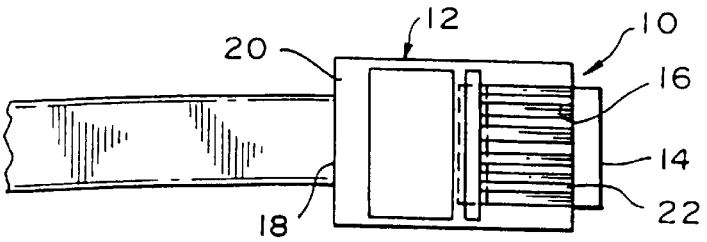
FIG. 1 PRIOR ART
FIG. 1 shows a top view of a prior art modular plug attached to an end of a telephone cord.
Figure 2:
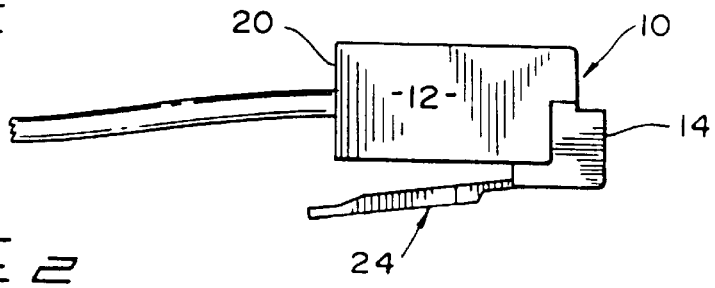
FIG. 2 PRIOR ART
FIG. 2 is a side view of the plug shown in FIG. 1.
Figure 3:
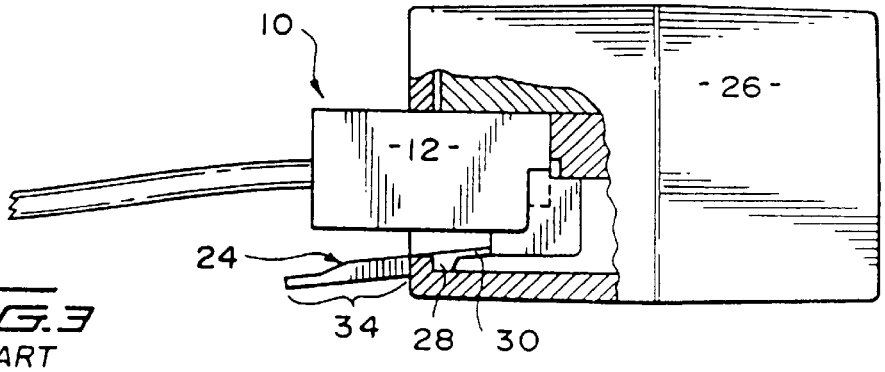
FIG. 3 PRIOR ART
FIG. 3 is a side view of the plug shown in FIG. 1 inserted into a standard telephone jack.

Due to the inherent resiliency of clip member 123, when modular plug 110 is inserted within a standard telephone jack, raised lip 266 will engage a housing portion of the jack so as to function in a manner substantially identical to detent member 128 of the known modular telephone plug discussed with reference to FIGS. 1–3 of the present application in order to selectively retain modular plug within the jack. When it is desired to remove modular plug 110, a user can simply force clip member 123 toward central body portion 117 of housing 112 in order to force tab 273 within recess 220. When rounded terminal end 276 abuts flattened section 224 of recess 220, clip member 123 will deflect to position raised lip 266 closer to central body portion 117 such that modular plug 110 can be readily pulled from the jack. By located tab 273 within recess 220, bending of clip member 123 away from central body portion 117 by engagement of first end portion 126 of clip member 123 with an external object is prevented. In addition, since clip member 123 is cantilevered at second end portion 129, relatively small bending angles are experienced at second end portion 129 throughout the use of modular plug 110 and therefore any fatigue failure is greatly reduced or eliminated as compared to standard modular telephone plugs.

As mentioned above, housing 112 is preferably constructed so it can be universally utilized with varying types of clip members. From the above description, it should be readily apparent that slot 201 is not utilized in securing clip member 123 to housing 112. Instead, slot 201 is used to secure another type of clip member to housing 112 as will be more fully discussed below. Since slot 201 is not utilized to secure clip member 123 to housing 112, if the modular telephone plug 110 of the present invention is formed with a clip member constructed in accordance with the above-described embodiment, housing 112 obviously need not be formed with slot 201 in this embodiment.

Figure 13:
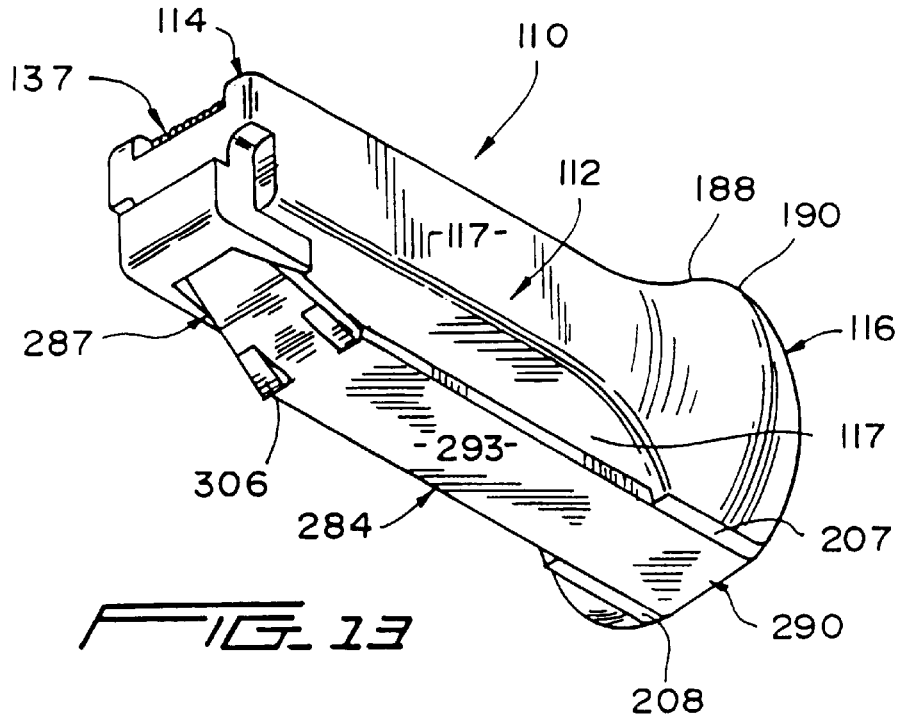
FIG. 13 is a perspective view of a second embodiment of the modular telephone plug of the invention.
Figure 14:
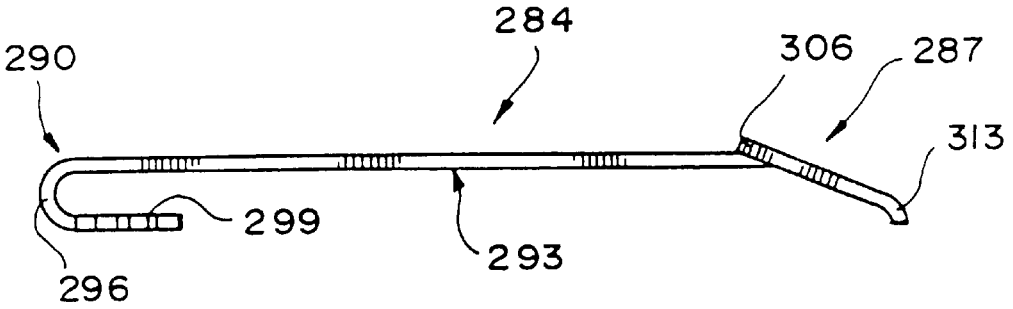
FIG. 14 is a side view of a retainer clip incorporated in the modular telephone plug embodiment of FIG. 13.
Figure 15:
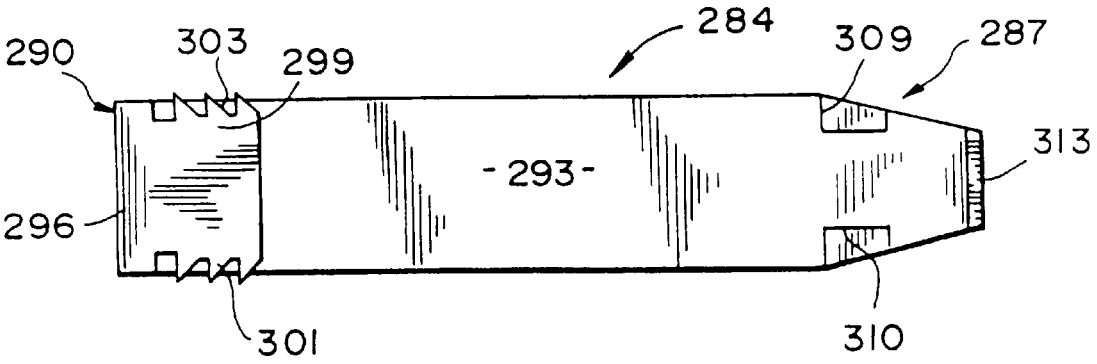
FIG. 15 is a bottom view of the retainer clip incorporated in the modular telephone plug embodiment of FIG. 13.

Reference will now be made to FIGS. 13–15 in describing a second preferred embodiment of the present invention wherein corresponding reference numerals refer to structure in the second embodiment that is identical to that described above with respect to the first embodiment. In essence, housing 112 is constructed identical to that described above with specific reference to FIGS. 6–10. However, the second embodiment includes a clip member 284 that is preferably formed of metal. More specifically, clip member 284 includes a first or locking end portion 287, a second or attaching end portion 290 and an elongated central portion 293 that integrally connects first and second end portions 287 and 290. Second end portion 290 defines a curved section 296 of clip member 284 and terminates in a serrated end 299. Serrated end 299 is actually constituted by a plurality of outwardly extending and longitudinally spaced prongs or spikes 301 that have outwardly and rearwardly extending angled surfaces 303. As will be discussed more fully below, serrated end 299 is adapted to be received within slot 201 for fixedly securing second end portion 290 of clip member 284 to housing 112.

First end portion 287 of clip member 284 includes a pair of laterally spaced locking detents or tabs 306. In the preferred embodiment shown, locking detents 306 are symmetrical and are each preferably formed by cutting, such as by a stamping operation, clip member 284 along lines 309 and 310 and then bending first end portion 287 relative to elongated central portion 293 such that locking detents 306 project upwardly relative to elongated central portion 293 as best illustrated in FIGS. 13 and 14. With this arrangement, first end portion 287 slopes relative to elongated central portion 293 and includes a downwardly turned terminal end 313. Terminal end 313 is adapted to extend within recess 220 in a manner directly analogous to tab 273 of the first described clip embodiment.

More specifically, clip member 284 is adapted to be secured to housing 112 by inserting serrated end 299 into slot 201. As will be noted from viewing FIG. 15, prongs 301 project laterally outwardly slightly beyond the lateral dimensions of the remainder of clip member 284 and therefore, when inserted into slot 201, prongs 301 will slightly deform slot 201. Due to the presence of angled surfaces 303 of prongs 301, serrated end 299 can be forced into slot 201 and will be retained against withdrawal therefrom by engagement of the prongs 301 within the slot 201. At the same time, terminal end 313 will extend into recess 220. From the above description, it should be readily apparent that utilization of clip member 284 obviates the need for the forming of bores 212–214.

The manner of locking modular telephone plug 110 incorporating clip member 284 is identical to that described above with respect to the first embodiment except that clip member 284 includes a pair of spaced locking detents 306 whereas raised lip 266 preferably extends entirely laterally across clip member 123. However, given the construction of a standard jack, approximately the same abutting surface area is provided in each of the embodiments constructed in accordance with the present invention.

Figure 16:
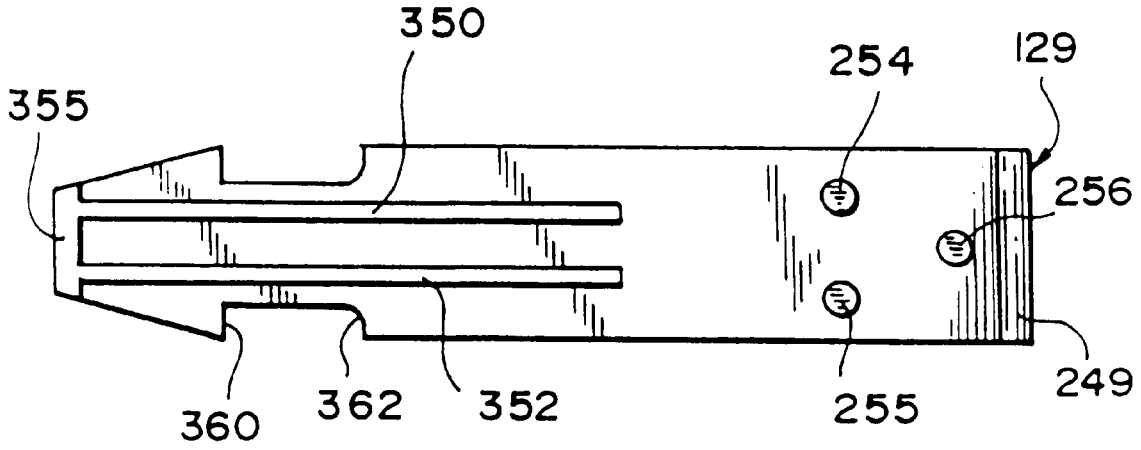
FIG. 16 is a bottom plan view similar to that of FIG. 11 but of a modified retainer clip.
Figure 17:
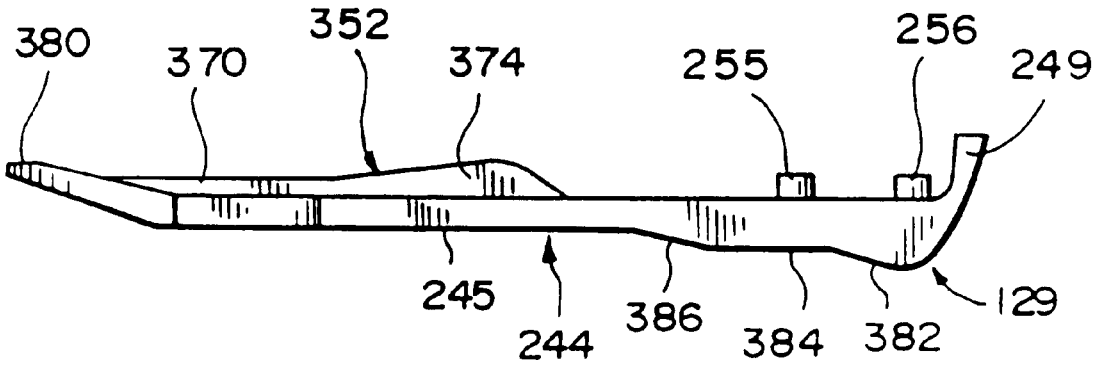
FIG. 17 is a side view of the retainer clip of FIG. 16.

As indicated above, FIGS. 16 and 17 illustrate a clip member similar to that of the embodiment of FIGS. 11 and 12 and therefore like reference numerals refer to corresponding parts which will not be described here. However, this clip member is provided with a plurality of longitudinally extending ribs 350 and 352 extending from a forward portion 355 thereof. Ribs 350 and 352 add structural integrity to the clip member and are identically constructed. As clearly shown in FIG. 16, the clip member includes opposing side cut-out portions (not labeled) that have linear front edges 360 and curvilinear rear edges 362. When received within a conventional jack in a manner directly analogous to that described above, edges 360 abut front wall portions of the jack to selectively retain the modular telephone plug in place.

As shown in FIG. 17, rib 352 includes a substantially flat, rearwardly extending portion 370 that leads to a sloping, enlarged portion 374. Rib 352 extends to adjacent a flat tip 380 which is adapted to extend within recess 220 of housing 112. Central portion 244 has a first side surface 245 substantially identical to the earlier disclosed embodiment, but second end portion 129 includes a first sloping portion 382, a generally flat portion 384 and a second sloping portion 386 that leads to central portion 244.

As emphasized above, an important aspect of the present invention is the ability of the modular plug 110 to be readily grasped by a user, even when the user is wearing gloves. This is particularly important for telephone repair personnel that need to insert modular telephone plugs within jacks outside of homes in cold weather climates. In accordance with the present invention, grasping and manipulating modular plug 110 is greatly enhanced as compared to a standard modular telephone plug due to the particular configuration of housing 112, as well as clip members 123 and 284. In addition to constructing housing 112 with second end 116 defining an enlarged head, housing 112 is greatly elongated as compared to a standard modular telephone plug. In the preferred embodiment, modular plug 110 is 1.1 to 1.5 inches in length (approximately 2.8 to 3.8 cm) and preferably 1.3 inches (3.3 cm) wherein a standard modular telephone plug is approximately ½ inch (1.27 cm). Therefore, when inserted into a standard telephone jack, the modular plug 110 of the present invention extends out of the jack a substantial distance which greatly aids in grasping and manipulating the modular plug, even if gloves are being worn by the user.

Although described with respect to preferred embodiments of the invention, it should be readily understood that various changes and/or modifications can be made to the present invention without departing from the spirit thereof. For instance, although adhesive is specifically disclosed in connecting the clip members to second end 116 of housing 112 in the various embodiments of the invention, other types of fastening arrangements known in the art could also be readily utilized. In addition, the second end portion 290 of clip member 284 in accordance with the second embodiment of the invention could also be secured within slot 201 by various fastening arrangements instead of the use of prongs or spikes 301. For instance, second end portion 290 of clip member 284 could simply be adhesively secured within slot 201 or another type of attaching arrangement could be utilized, other than that of slot 201, for supporting clip member 284 in a cantilevered manner. In fact, the clip member could be integrally molded with the housing in a cantilevered manner. In general, the invention is only intended to be limited by the scope of the following claims.

We claim:

1. A modular telephone plug comprising:

an elongated dielectric housing having first and second longitudinally spaced end portions, said first end portion defining an electrical connector section adapted to fit into a standard telephone jack, said housing including an internal channel, extending from the second end portion to the first end portion of the housing, which is adapted to receive a multi-conductor telephone wire terminating at the electrical connector section; and a clip member attached and deflectable relative to said housing, with said clip member having an associated width and first and second end portions, said clip member being provided with a raised lip which is located closer to the first end portion than the second end portion of the clip member and extends across at least a portion of the width of the clip member, said clip member being further provided with a pair of laterally spaced cut-out portions adjacent the lip wherein, when the first end portion of the housing is inserted into a standard telephone jack, the clip member initially deflects towards said housing to enable the lip to entirely enter and abut the telephone jack for selectively retaining the modular telephone plug in the telephone jack.

2. The modular telephone plug according to claim 1, wherein the pair of laterally spaced cut-out portions are formed between the lip and the second end portion of the clip member.

3. The modular telephone plug according to claim 1, wherein the first end portion of said clip member tapers away from the lip.

4. The modular telephone plug according to claim 3, wherein the first end portion of said housing is formed with a recess into which the tapered first end portion of the clip member extends.

5. The modular telephone plug according to claim 4, wherein the first end portion of said clip member includes a rounded, laterally extending terminal end.

6. The modular telephone plug according to claim 1, wherein the clip member includes a central portion between the first and second end portions, with the first end portion of the clip member sloping in a first direction from the central portion and the second end portion of the clip member sloping in a different direction from the central portion.

7. The modular telephone plug according to claim 1, wherein said clip member is attached in a cantilevered manner to the second end portion of said housing.

8. The modular telephone plug according to claim 7, wherein the second end portion of said housing is formed with a flattened section between upstanding wall portions, the second end portion of said clip member being attached to said housing between the upstanding wall portions.

9. The modular telephone plug according to claim 1, wherein the second end portion of said housing includes an enlarged, generally rounded portion.

* * * * *